United States Patent [19]

Smith

[11] Patent Number: 4,739,622

[45] Date of Patent: Apr. 26, 1988

[54] APPARATUS AND METHOD FOR THE DEEP CRYOGENIC TREATMENT OF MATERIALS

[75] Inventor: James A. Smith, Phoenix, Ariz.

[73] Assignee: Cryogenics International, Inc., Tempe, Ariz.

[21] Appl. No.: 77,801

[22] Filed: Jul. 27, 1987

[51] Int. Cl.[4] ..... F24F 3/16

[52] U.S. Cl. ..... 62/78; 62/216; 62/223; 62/457

[58] Field of Search ..... 62/78, 216, 223, 457

[56] References Cited

U.S. PATENT DOCUMENTS

| | | | |
|---|---|---|---|
| 4,030,314 | 6/1977 | Strehler | 62/78 |
| 4,328,676 | 5/1982 | Reed | 62/457 |
| 4,455,842 | 6/1984 | Granlund | 62/78 |

*Primary Examiner*—Ronald C. Capossela
*Attorney, Agent, or Firm*—Philip D. Junkins

[57] ABSTRACT

Apparatus and methodology for the ultralow temperature processing of metallic, carbide, ceramic and plastic parts and items to materially increase their wear, abrasion, erosion and corrosion resistivity, stabilize their strength characteristics, improve their machinability and provide stress relief. The cryogenic treatment processing is carried out in an insulated box-like treatment chamber which includes a perforated platform extending parallel to and spaced above the bottom of the chamber. Parts and items to be treated are supported on the platform and cryogenic liquid is introduced to the chamber below the platform in accordance with a time-temperature program which reduces the temperature of the parts and items in stages to −320° F. by initial cooling of the parts and items by evaporating vapors from the cryogenic liquid pool in the space below the platform and thereafter by partial or substantial submersion of the parts and items in the cryogenic liquid. After a soak period at the −320° F. temperature level, the temperature of the parts and items in the treatment chamber is raised to ambient by controlled evaporation of the cryogenic liquid therein. Temperature and liquid level monitoring devices are mounted in the treatment chamber and information derived therefrom is utilized by a process controller to direct the supply of cryogenic liquid to the treatment chamber in accordance with the desired temperature descent and ascent profiles for the weight of the parts within the chamber.

14 Claims, 3 Drawing Sheets

APPARATUS AND METHOD FOR THE DEEP CRYOGENIC TREATMENT OF MATERIALS

BACKGROUND OF THE INVENTION

The present invention relates to the improvement of materials through low temperature treatment. More particularly, the invention relates to the improvement of abrasive wear, corrosive wear, erosive wear and related physical characteristics, i.e., stress relief and stabilization, in a wide variety of materials, including metals, metallic alloys, carbides, plastics and ceramics, through deep cryogenic processing.

Ultralow temperature treatment (−300° F. to −320° F.) or deep cryogenic processing of metals, particularly metals in the form of cutting tools, has been known to show some improvement in abrasion and corrosion resistance along with reduction of internal stresses and improved material stability. Thus, ultralow temperature treatment of metal tools results in improvement in the wear resistance of such tools (increases tool life) whereas the heat treatment of metal tools is utilized to obtain desired combinations of metal hardness, toughness and ductility. With deep cryogenic processing there is no change in the dimension, size or volume of the parts or items treated, and the hardness of the items is not altered.

Deep cryogenic processing has been used for the wear improvement treatment of: industrial cutting tools (dies, stamping dies, drills, end mills, taps, reamers, hobs, gear cutters, broaches, etc.); hand tools (knives, chisels, plane irons, saws, punches, files, etc.); turbine blades; rotating and sliding machine items (ball and roller bearings, piston rings, bushings, etc.); springs; resistance welding electrodes; and castings and forgings. The materials treated have included: steel and steel alloys; titanium and titanium alloys; high-nickel alloys; copper and brass; aluminum and aluminum alloys; metal carbides and nitrides; ceramic materials; and a wide variety of plastic materials including nylons and teflons.

Ultralow temperature treatment has been principally carried out using liquid nitrogen as the cooling medium. Temperature descent from ambient temperature to deep cryogenic temperatures of −300° F. to −320° F. takes, under most known cryogenic procedures, about 8 hours. The parts or items under treatment are maintained at the ultralow temperature for 10–20 hours and then returned to ambient temperature over a period of as much as 30 hours. The treatment results are frequently unpredictable.

For industrial items made of steel and steel alloys, deep cryogenic treatment seems to remove the kinetic energy of the atoms making up such items. There is a normal attraction between atoms but their energy of motion tries to keep them apart unless such energy is removed, as by low temperature treatment. Treatment at below −300° F. transforms retained soft austenite (one form of crystalline steel) into the more stable hard martensite form of steel. During this transformation, additional smaller carbon carbide particles are released and evenly distributed throughout the mass of the material. These smaller carbide particles help support the martensite matrix. In cutting tools, this reduces the heat buildup on the cutting edge and this in turn increases the wear resistance of the tools. Improvements in the resistance to wear can and does reduce the cost of products produced by machine tools because of longer tool life, less scrap, fewer rejections and less production downtime. It has been reported that deep cryogenic treatment of tool steel alloys has resulted in improvement in wear resistance by factors of as much as 2–6 times.

It is an object of the present invention to provide an improved treatment chamber for carrying out the deep cryogenic processing of metallic, carbide, ceramic and plastic parts and items to increase their wear resistivity with a high degree of predictability.

It is a further object of the invention to provide unique apparatus for effecting the deep cryogenic treatment of metallic, carbide, ceramic and plastic parts and items under optimum time-temperature profiles to achieve highly efficient processing results and predictable repeatability.

It is another object of the invention to provide an improved method for carrying out ultralow temperature treatment of metallic, carbide, ceramic and plastic parts and items to increase the wear resistivity of such parts and items.

It is yet another object of the invention to provide an improved method for carrying out the efficient and reliable deep cryogenic treatment of metallic, carbide, ceramic and plastic parts and items utilizing optimum time-temperature processing profiles to increase the wear resistivity and stability of such parts and items.

Other objects and advantages of the invention will be apparent from the following detailed description of the invention, taken with the accompanying drawings.

SUMMARY OF THE INVENTION

The present invention relates to an improved and unique treatment chamber for carrying out the deep cryogenic processing of metallic, carbide, ceramic and plastic items and parts to materially increase their wear resistivity, improve their machinability, and provide stress relief and stabilization. The invention also relates to the cryogenic processing methodology practiced during the utilization of the treatment chamber of the invention. The unique treatment chamber comprises a fully insulated box with a removable or hinged top and a parts platform (uniformly perforated) located a short distance above the inside bottom surface of the chamber. A cryogenic liquid delivery pipe enters the treatment chamber at a point near the top of one of the chamber's side walls and extends downwardly to a point near the bottom of the chamber. The delivery pipe has a liquid discharge port (or extends as a delivery manifold) below the parts platform and introduces the cryogenic liquid to the chamber without splashing or splattering such liquid on parts and items supported on the platform, thereby avoiding detrimental thermal shock of such parts and items frequently causing cracks and fractures therein. Temperature measurement and liquid level monitoring sensors provide indication of processing conditions within the treatment chamber for direction of the processing program to optimize treatment results and efficiencies.

The unique methodology of the invention provides for the carrying out of the time-temperature processing cycle profiles related to the total weight of the parts being processed in the ultralow temperature treatment chamber. The process cycles include a sequence of modes of operation including: (a) descend (ambient temperature to −200° F.) over 3–24 hours without part contact with any cryogenic liquid ; (b) grid-level (−200° F. to −280° F.) over 1–12 hours, again with no submersion of parts in the cryogenic liquid; c) pre-soak (−280° F. to −300° F.) over 0.5 to 13 hours with submersion of parts in the cryogenic medium of up to 50% to 75% of the maximum liquid level height; (d) soak (−300° F. to −320° F.) for 24 hours with submersion of parts in the cryogenic medium of up to 75% to 100% of the maximum liquid level height; and (e) ascend (−320° F. to ambient) for 8 to 46 hours with the cryogenic liquid allowed to evaporate (boil off) until the chamber is free of such medium and the chamber temperature has reached ambient. One or more submersion heaters may be cycled on-off during the ascend mode to assure that a uniform temperature ascend profile is maintained. Liquid levels are adjusted within the descend, grid-level, pre-soak, and soak modes in accordance with multiple temperature sensors (thermocouples).

Through operation of the apparatus of the invention, and practice of the methodology, significant improvement of wear resistance of metallic, carbide, ceramic and plastic materials has been achieved with highly predictable repeatability. Practice of the methodology may add as much as 10–15% to the basic cost of parts or items treated but materially improves wearability thereof, thus increasing part life by 2–6 times, without changing the other desirable physical characteristics of such parts. No dimensional changes occure in the parts processed by the ultralow temperature processing.

BRIEF DESCRIPTION OF THE DRAWING FIGURES

DETAILED DESCRIPTION OF THE INVENTION

Figure 1:
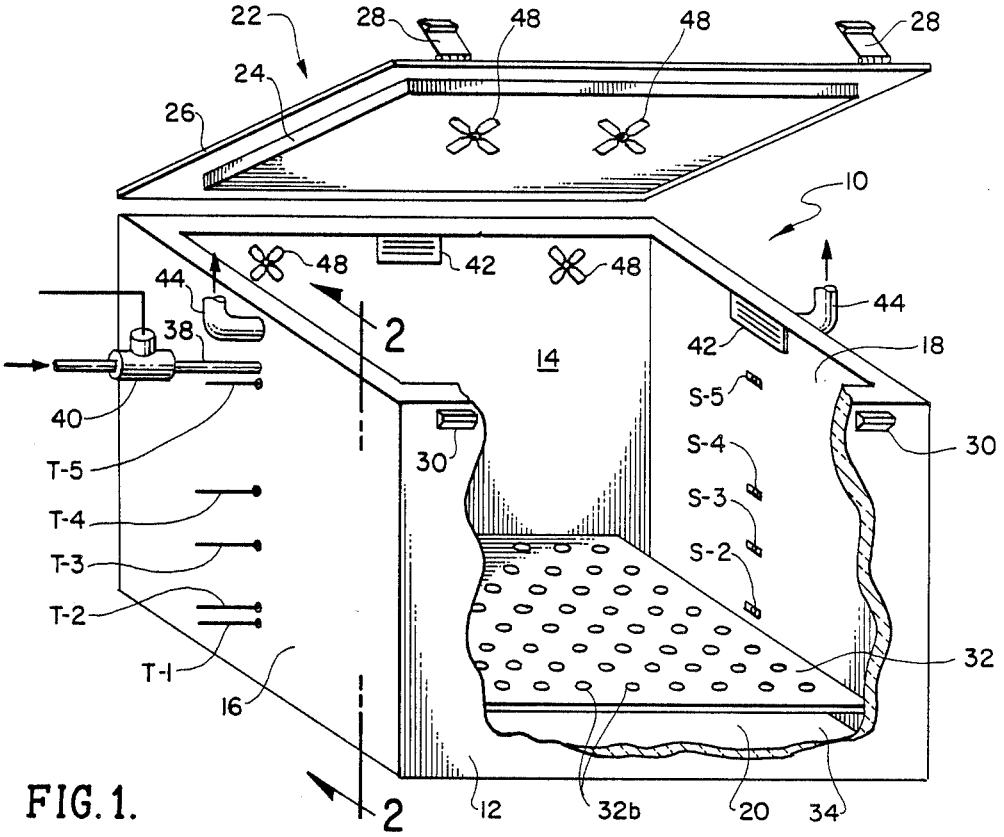
FIG. 1 is a perspective view of an ultralow temperature treatment chamber, front wall partially cut away and top in an open position, for carrying out deep cryogenic processing of materials in accordance with the present invention.

Referring initially to FIG. 1 there is shown in a perspective view, partially cut away, an ultralow temperature treatment chamber 10 for carrying out deep cryogenic processing of metallic, carbide, ceramic and plastic parts and items to greatly improve their resistivity to abrasion wear, corrosive wear, and erosion wear in accordance with the present invention. The chamber 10 is comprised of front and rear walls 12 and 14, respectively, side walls 16 and 18 and a bottom wall 20. These walls are all formed of a relatively thick center layer of insulating material, such as a rigid foam plastic material, with an inside sheath of aluminum alloy sheeting and outside welded sheath of steel sheeting of adequate thickness to provide structural integrity to the chamber 10 to support and contain the load of materials (parts or items) to be processed within the chamber. The inside metallic sheathing must be sealed at all seams (as by welding) to provide a liquid-tight inner shell for the chamber. The chamber size is dictated by the size and number of parts that the user desires to process in a single treatment batch. The chamber, therefore, may be fabricated to hold as little as 50 pounds of parts and have an effective internal processed-parts volume of 1 cubic foot, or the chamber may be constructed (with appropriate outer sheath structural reinforcement) to hold 20,000 pounds or more of parts and have an internal processed-parts volume of 250 cubic feet or more.

The chamber 10 is provided with a removable top 22 (as shown in FIG. 1) or with a hinged lid. The top 22 or lid is comprised of a relatively thick layer of insulating material and outer steel plate 26. As in the case of the chamber walls, an insulation layer 24 comprises part of top 22. The insulation material is encased in an inside sheath of steel sheeting and such sheath is appropriately welded to top plate 26. Whether hinged to chamber 10 or structured to be entirely removable (as shown in FIG. 1), the chamber top 22 must be designed to provide sealing closure of chamber 10 during the ultralow temperature processing of parts therein. Thus, an appropriate number of latch-lock fasteners 28 must be provided around the periphery of the top 22 for engagement with mating fastener means 30 affixed to the upper portions of the front, back and side walls of chamber 10.

The lower portion of cryogenic treatment chamber 10 is provided with a removable raised parts support platform or grid 32 (may be supported above bottom wall 20 as by brackets **32*a*) to provide a space 34 (between bottom wall 20 and platform 32) for the initial charge to the chamber of cryogenic liquid. The platform or grid 32 is uniformly perforated with small holes 32*b* for the passage of the extremely cold vapor (evaporating from cryogenic liquid in space 34) or cryogenic liquid itself into the upper areas of chamber 10 for cooling contact with parts P supported on platform 32 and undergoing ultralow temperature treatment in accordance with the invention. The cryogenic liquid cooling medium (preferably liquid nitrogen having a boiling point temperature of −320° F.) is introduced to the bottom area 34 of chamber 10 through a fluid feed pipe or conduit 36 which extends downwardly from its upper chamber entry pipe section 36*a* to its fluid discharge end 36*b*. As shown in FIG. 3, the feed pipe 36 may be connected at its lower end 36*b* to (and feed) a fluid distribution manifold 36*c* which includes side rows of uniformly spaced perforations or ports 36*d*. The feed pipe 36 is fed with cryogenic liquid through supply line 38 extending through chamber wall 16. The rate of liquid feed through line 38 is controlled and directed by a pulse rated solenoid valve 40 as described hereinafter. The manifold or phase separator 36*c* sits in a slightly elevated position (as by support legs, not shown) above bottom wall 20 and such position and the arrangement of manifold or phase separator perforations or distribution ports 36*d* results in a substantially uniform distribution and mixing of the cryogenic liquid over and throughout bottom area 34 of the chamber 10. Thereby, particularly for large size treatment chambers, the evaporation of the cryogenic liquid to cooling vapor is highly controllable and uniform over the liquid surface and upwardly into the upper areas of the chamber 10. The feed pipe discharge end 36*b* (FIG. 2) or configuration of the manifold 36*c* (when utilized as shown in FIG. 3) and the perforated platform 32 design (supporting the parts and items undergoing ultralow temperature processing) cooperate to prevent splattering and splashing of cryogenic liquid onto the materials on the platform thereby avoiding the occurence of sudden damaging thermal shock to such materials. Splashing and splattering of cryogenic liquid within chamber 10 is also avoided by the controlled relatively slow entry rate of such liquid into the chamber through the manifold's distribution ports 36***d* until the mixing pool of cryogenic liquid in the bottom of the chamber has reached a pre-programmed level.

At the top of the treatment chamber 10, positioned appropriately on the front, back and/or side walls, there is located one or more gas exhaust vents 42, with associated exhaust piping 44, so that warmer gas or vapor (accumulating near the top of the chamber) can escape the chamber carrying out the heat energy given up by the materials under treatment within the chamber. Also mounted at the bottom of one or more of such walls (or on the chamber floor 20) are submersible strip heater units 46 which (as described hereinafter) are utilized during the part of the processing cycle wherein temperature ascent is effected. For further use in connection with the control of the temperature ascent portion of the processing cycle, there is provided one or more gas circulation fans 48 which depend from inside the chamber top or lid 22 and/or are mounted at the top of the chamber walls and are driven by appropriate fan motors 50 controlled by the time-temperature program circuitry.

Along the height of side wall 18 there are positioned quench control sensors S-1, S-2, S-3, S-4 and S-5 which monitor the level of the cryogenic liquid in the treatment chamber and report the varying liquid levels to the system's process cycle control center. Sensor S-1 is located about midway between bottom wall 20 and platform or grid 32 and sensor S-2 is located at the grid level. Sensor S-5 is located at the point of maximum permissible liquid level within chamber 10 and below the entry height of feed pipe 36 (height of entry pipe section 36*a*). Sensors S-3 and S-4 are positioned intermediate sensors S-2 and S-5 with appropriate spacing. Positioned on the side wall 16 of chamber 10 are electronic temperature sensors T-1, T-2, T-3, T-4 and T-5 located at the same levels within the chamber as the liquid level sensors S-1 to S-5 to measure the temperature of the ultracold vapor circulating about the parts under treatment in the upper part of the chamber and of the cryogenic liquid in the lower part of the chamber. The treatment chamber 10 may be provided with a second set of temperature sensors T-1 to T-5 located on one of the other walls of the chamber at like vertical locations with the temperature sensed by each pair of sensors T-1, T-2, etc. being averaged by the process control circuitry so that more accurate measurement of the temperature conditions within the chamber is obtained for utilization in control of the cryogenic treatment program.

Figure 2:
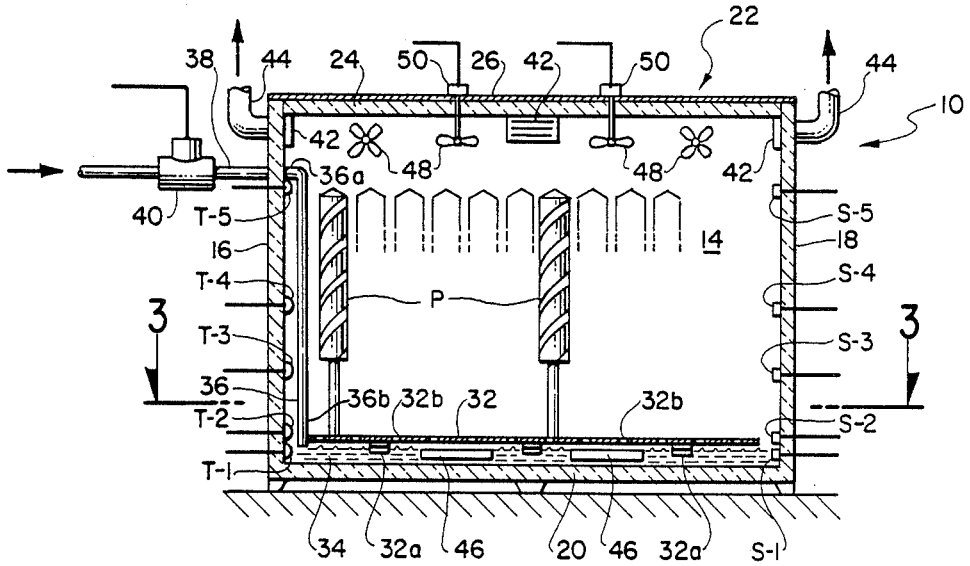
FIG. 2 is a front section view of the treatment chamber of FIG. 1 taken on line 2—2 of FIG. 1.
Figure 3:
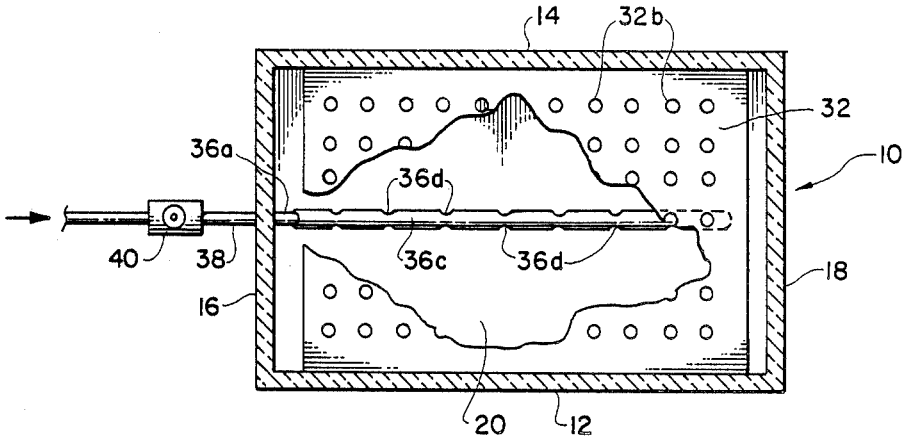
FIG. 3 is a top section view of the treatment chamber of FIG. 1 taken on line 3—3 of FIG. 2.

FIG. 2, as a front section view of the treatment chamber of FIG. 1, should be referred to for its showing of the elevation relationships of the parts support platform 32, quench control sensors S-1 to S-5 and temperature sensors T-1 to T-5. Such figure also shows the positions of the gas exhaust vents 42 and heaters 46 on the chamber walls at the bottom of the chamber 10, as-well-as the position of the circulating fans 48. FIG. 3, as a top section view of the treatment chamber of FIG. 1, should be referred to for its showing of the configuration of the cryogenic liquid distribution manifold or phase separator 36 (when it is used in large treatment chambers) and the position of the rows of liquid discharge ports 36*d* to assure substantially uniform fluid distribution and mixing of the cryogenic liquid entering chamber 10 below the parts support platform or grid 32.

Figure 4:
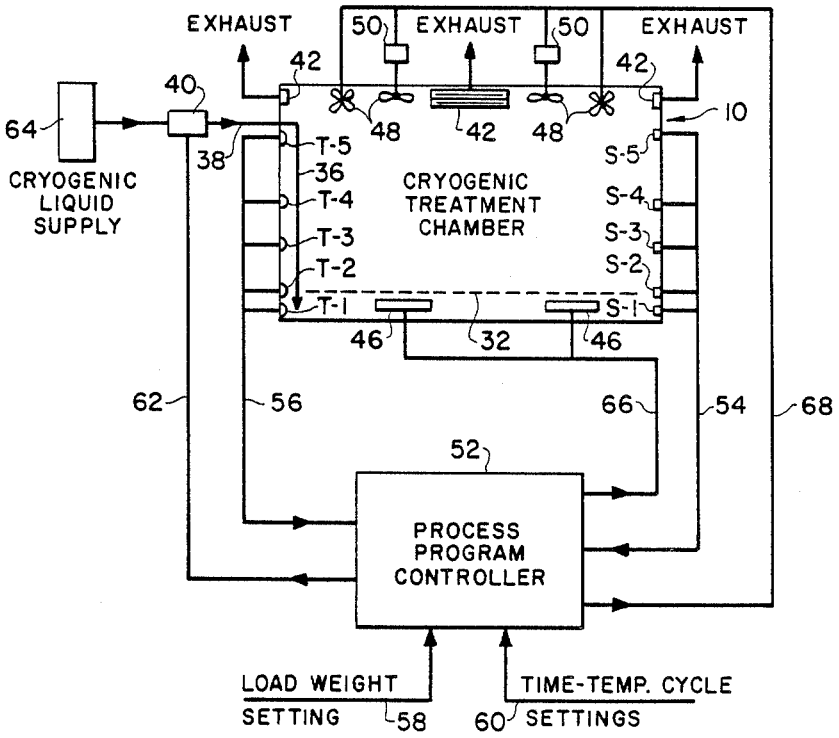
FIG. 4 is a schematic block diagram showing the principal apparatus components and operational systems, with interconnections, of the invention.

Referring now to FIG. 4, there is shown in schematic block diagram fashion the principal components and operational systems, with interconnection, of the ultra-low temperature treatment system of the invention. The cryogenic treatment chamber 10 is shown to contain parts platform 32, liquid distribution feed pipe 36, exhaust gas vents 42, heaters 46 and circulation fans 48, as-well-as liquid level sensors S-1 to S-5 and temperature sensors T-1 to T-5. A process program controller 52 is interconnected to the treatment chamber so as to receive liquid level measurements from sensors S-1 to S-5 (via transmission cable 54) and temperature measurements from sensors T-1 to T-5 by transmission cable 56. Information relative to the weight of the parts to be treated within chamber 10 is input to the controller 52 (load weight settings 58) along with appropriate time-temperature cycle data (cycle profile settings 60). Control of the cryogenic treatment process, to and through the "soak" mode, is accomplished by controller 52 (including its software program) through direction (via cable 62) of pulse rated solenoid valve 40 (located in cryogenic liquid supply line 38), thereby initiating and regulating the rate of flow of cryogenic liquid to the fluid distribution feed pipe 36. Supply line 38 connects to cryogenic liquid supply vessel 64. Following the 24 hour "soak" mode the temperature "ascend" mode is commenced with the termination of all cryogenic liquid feed into chamber 10 and, in accordance with the "ascend" mode temperature rise profile (set into the software program followed by program controller 52), the controller initiates the operation of heaters 46 and circulation fans 48 (as required) via direction communicated through cables 66 and 68, respectively. The heaters and circulation fans are utilized, as required, to speed up the evaporation of the cryogenic liquid within the treatment chamber and maintain the pre-programmed temperature profile during the "ascend" mode and return the chamber and its parts contents to ambient temperature.

As previously indicated, the improved method of the invention for carrying out the efficient deep cryogenic treatment of metallic, carbide, ceramic and plastic parts and items to significantly increase the wear resistivity of such parts and items, includes the process modes of: (a) "descend", (b) "grid-level", (c) "pre-soak", (d) "soak" and (e) "ascend". In prior art cryogenic treatment methods only three modes of processing have been used, including: (a) temperature descent from ambient to temperatures in the range of −300° F. to −320° F. in about 8 hours, followed by (b) a soak period (at the −300° F. to −320° F. level) of 10–20 hours, and (c) a temperature acsent period of as much as 30 hours. Such processing has classically been carried out "dry", i.e., without the treated parts comming in direct contact with any cryogenic liquid. Although the wear resistivity of treated parts has been noted to improve as a result of such processing, the results for like parts have been inconsistent and unpredictable with reliable certainty.

The unique processing methodology of the present invention requires that the parts under ultralow temperature treatment be kept dry only during the "descend" and "grid-level" modes, i.e., during the period within which the temperature within the treatment chamber is first reduced from ambient to −200° F., a period of about 3 to about 24 hours for load weights ranging from 50 to 20,000 pounds, and then reduced from −200° F. to −280° F. over a period of about 1 to about 12 hours. Thereafter, the parts are no longer susceptible to thermal shock by contact with the cryogenic liquid and the succeeding process modes are carried out with the cryogenic liquid partially or fully submerging the parts under treatment. For load weights ranging from 50 to 20,000 pounds, the "pre-soak" mode (temperature descent from about −280° F. to about −300° F.) lasts for a period of from about 0.5 hour to about 13 hours and, as previously indicated, the "soak" mode (−300° F. to −320° F.) lasts for 24 hours. The "ascend" mode for the load weight range of 50 to 20,000 pounds (−320° F. to ambient temperature) lasts for about 8 hours to about 46 hours.

Figure 5:
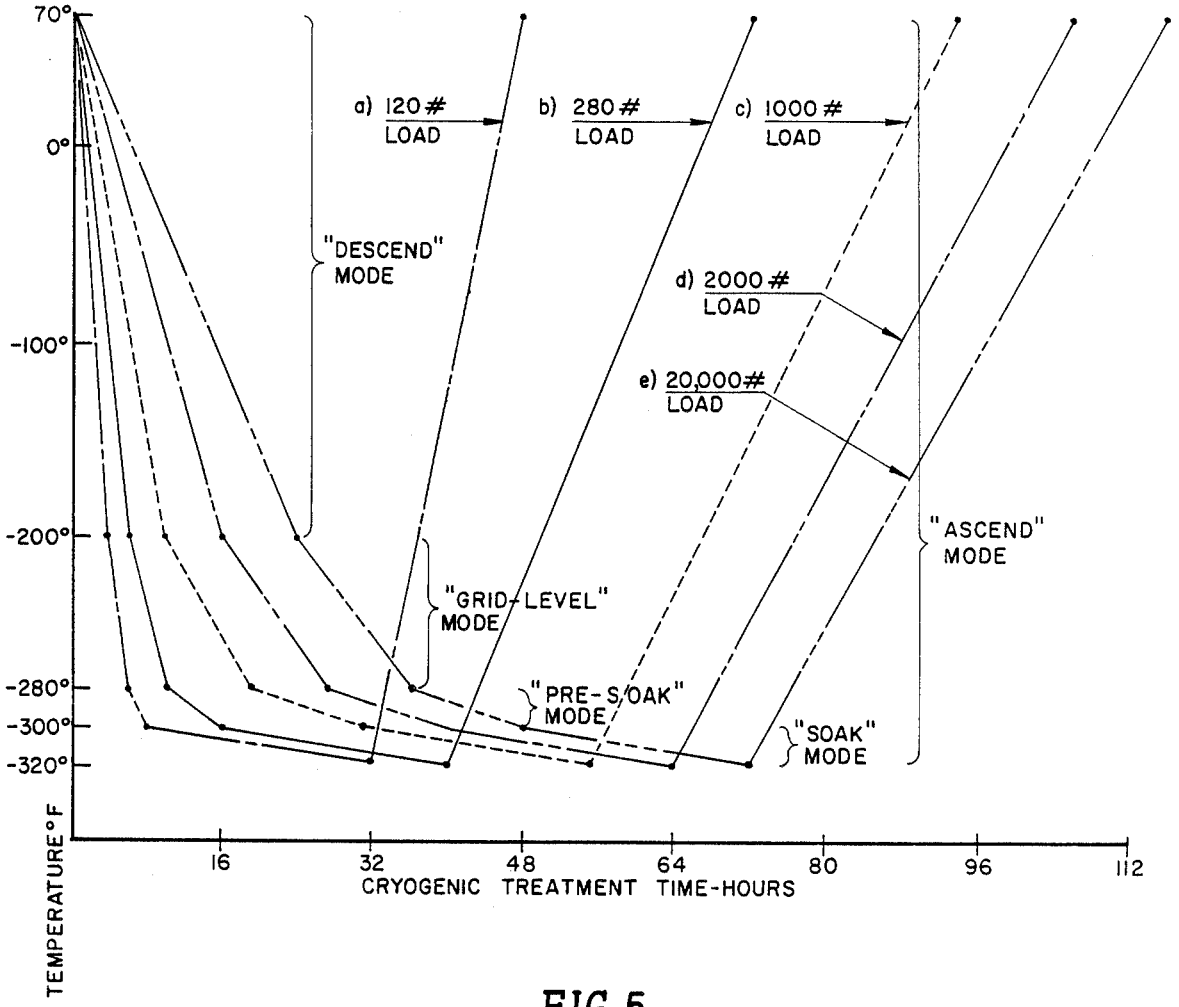
FIG. 5 is a time-temperature diagram showing processing profiles for cryogenic treatment of five weight loadings of metallic parts in accordance with the invention.

In FIG. 5 there is presented a series of time-temperature diagrams showing processing mode profiles for the cryogenic treatment of a number of treatment chamber loadings of metallic parts in accordance with the invention. Treatment mode periods are indicated for chamber loadings of: 120 pounds, 280 pounds, 1,000 pounds, 2,000 pounds and 20,000 pounds of the metallic parts.

Through practice of the methodology of the invention, and utilization of the treatment chamber apparatus thereof, substantial improvement in part wearability has been achieved with high reliability and repeatability. Thus, for example: high silicon steel alloy drill bits have shown a life improvement of 2 to 1 over untreated bits; carbide faced milling tools have shown a life improvement of 4 to 1; high-nickel hobs (used by turbine blade manufacturers) have shown a life improvement of 3 to 1; stainless steel razor blades have shown a life improvement of 15 to 1; and copper electrodes an improvement of 6 to 1.

In the specification and drawing figures there has been set forth preferred embodiments of the invention and although specific terms have been employed, they are used in a generic and descriptive sense only and not for purposes of limitation, the scope of the invention being defined in the following claims.

What is claimed is:

1. Apparatus for carrying out the deep cryogenic processing of metallic, carbide, ceramic and plastic parts to materially increase their wear, abrasion, erosion and corrosion resistivity, stabilize their strength characteristics, improve their machinability and provide stress relief comprising:

(a) a box-like treatment chamber including side and end walls and a bottom wall each constructed of a central core of temperature insulating material with inner and outer metallic sheathing, the inner metallic wall sheathing of said chamber being sealed at each intersecting corner and seam thereof to render said chamber liquid tight and of sufficient thickness and character to withstand long-term exposure to cryogenic liquids at temperatures of at least as low as −320° F., the central insulation core of each wall of said chamber having sufficient temperature insulating properties so as to maintain the external temperature of said chamber at approximately ambient temperature when the inside of said chamber is exposed to cryogenic liquids at temperatures of at least as low as −320° F.;

(b) a top closure for said chamber constructed of a central core of temperature insulating material with inner and outer metallic sheathing, said top closure being sealable to said chamber and the central insulation core of said closure having sufficient temperature insulating properties so as to maintain the external temperature thereof at approximately anbient temperature;

(c) a perforated platform for supporting parts to be treated within said chamber, said platform being positioned within said treatment chamber parallel to and spaced above the bottom wall thereof and defining with said bottom wall a chamber space into which cryogenic liquid may be introduced to said chamber without contact with parts to be treated which are supported on said platform;

(d) cryogenic liquid supply feed pipe means within said treatment chamber and having liquid discharge means positioned between said perforated platform and the bottom wall of said chamber and oriented to distribute cryogenic liquid to the chamber space below said perforated platform without splashing said liquid above said platform;

(e) cryogenic process controller means for receiving a program of temperature descent and temperature ascent profile information, parts loading weight information, and monitored temperature and liquid level information respecting said treatment chamber and for directing the supply of cryogenic liquid to said treatment chamber in accordance with said program and monitored information;

(f) means for supplying cryogenic liquid to said feed pipe means as directed by said controller means to carry out the temperature descent profile and temperature ascent profile program for the ultralow temperature treatment of parts within said treatment chamber and positioned on said perforated platform;

(g) means at the upper portion of said treatment chamber for exhausting low temperature vapor, evaporating from the cryogenic liquid within said chamber, from said chamber with the removal of heat energy therewith; and (h) temperature and liquid level measuring means within said treatment chamber for monitoring the temperature of cryogenic liquid and evaporating vapor and the level of cryogenic liquid within said chamber and for reporting same to said controller means for utilization by said controller means to direct the feed pipe supply means in its delivery of cryogenic liquid to the chamber space below said perforated platform to maintain the temperature within said treatment chamber in accordance with the descent and ascent profiles of said ultralow temperature treatment program.

2. Apparatus for carrying out the deep cryogenic processing of metallic, carbide, ceramic and plastic parts as claimed in claim 1 wherein the means for supplying cryogenic liquid to said feed pipe supply means comprises a cryogenic liquid supply storage vessel and a pulse rated solenoid valve in the piping between said vessel and said feed pipe supply means, said valve being operated by said controller means.

3. Apparatus for carrying out the deep cryogenic processing of metallic, carbide, ceramic and plastic parts as claimed in claim 1 wherein heater means are provided within said treatment chamber at the bottom portion thereof for heating the cryogenic liquid therein during the temperature ascent portion of an ultralow temperature program for accelerating the evaporation of said liquid.

4. Apparatus for carrying out the deep cryogenic processing of metallic, carbide, ceramic and plastic parts as claimed in claim 1 wherein fan means are provided within said treatment chamber at the upper portion thereof for circulating cryogenic vapor within the upper part of said chamber above the level of cryogenic liquid therein prior to and during the temperature ascent portion of an ultralow temperature processing program for aiding in the control of the evaporation of said liquid.

5. Apparatus for carrying out the deep cryogenic processing of metallic, carbide, ceramic and plastic parts as claimed in claim 1 wherein the temperature measuring means within said treatment chamber consists of electronic temperature sensors located at a multiplicity of levels in said chamber including at least the level of the perforated platform for supporting parts to be treated within said chamber and the maximum level to which cryogenic liquid is to be permitted to rise within said chamber.

6. Apparatus for carrying out the deep cryogenic processing of metallic, carbide, ceramic and plastic parts as claimed in claim 1 wherein the liquid level measuring means within said treatment chamber consists of electronic liquid level sensors located at a multiplicity of levels in said chamber including at least the level of the perforated platform for supporting parts to be treated within said chamber and the maximum level to which cryogenic liquid is to be permitted to rise within said chamber.

7. Apparatus for carrying out the deep cryogenic processing of metallic, carbide, ceramic and plastic parts as claimed in claim 1 wherein the temperature and liquid level measuring means within said treatment chamber consist of electronic sensors which measure both the temperature and liquid levels at a multiplicity of levels in said chamber including at least the level of the perforated platform for supporting parts to be treated within said chamber and the maximum level to which cryogenic liquid is to be permitted to rise within said chamber.

8. Apparatus for carrying out the deep cryogenic processing of metallic, carbide, ceramic and plastic parts as claimed in claim 1 wherein the cryogenic liquid supply feed pipe means includes a manifold section extending longitudinally across the bottom wall of said treatment chamber below said perforated platform, said manifold section having a multiplicity of liquid discharge ports along its length to distribute cryogenic liquid to the chamber space below said platform.

9. A method for carrying out the deep cryogenic processing of metallic, carbide, ceramic and plastic parts to materially increase their wear, abrasion, erosion and corrosion resistivity, stabilize their strength characteristics, improve their machinability and provide stress relief comprising:

(a) positioning said parts within a closed insulated low temperature treatment chamber above a pool of cryogenic liquid and subjecting said parts to the cold vapors evaporating from said pool to cool said parts over a period of from about 3 hours to about 24 hours to reduce the temperature of said parts to about −200° F.;

(b) increasing the volume of said cryogenic liquid pool within said closed chamber below said parts to further cool said parts by the cold vapors evaporating from said pool over an additional period of from about 1 to about 12 hours to reduce the temperature of said parts to about −280° F.;

(c) further increasing the volume of said cryogenic liquid within said closed chamber to partially submerge said parts in said liquid and thereby further cool same over a period of from about 0.5 to about 13 hours to reduce the temperature of said parts to about −300° F. to about −320° F.;

(d) still further increasing the volume of said cryogenic liquid within said closed chamber to further submerge said parts in said liquid and soaking said parts therein over a period of about 24 hours to maintain said parts at a temperature of about −320° F. during said period; and (e) permitting the cryogenic liquid within said chamber to evaporate over a period of from about 8 hours to about 46 hours with the removal of the vapors of evaporation from said closed chamber whereby the temperature of said parts increases to ambient temperature.

10. The method for carrying out the deep cryogenic processing of metallic, carbide, ceramic and plastic parts as claimed in claim 9 wherein the weight of the parts to be processed within said closed treatment chamber is between 50 and 20,000 pounds.

11. The method for carrying out the deep cryogenic processing of metallic, carbide, ceramic and plastic parts as claimed in claim 9 wherein heat is added to said closed treatment chamber during the period within which said cryogenic liquid is permitted to evaporate without the addition of cryogenic liquid to accelerate the evaporation of said liquid.

12. The method for carrying out the deep cryogenic processing of metallic, carbide, ceramic and plastic parts as claimed in claim 9 wherein the temperatures of the pool of cryogenic liquid within said closed treatment chamber and the vapors evaporating from said pool are continuously monitored during the periods of reduction of temperature and period of increase of temperature in said chamber, and the level of cryogenic liquid within said closed treatment chamber is continuously monitored during the periods of reduction of temperature and period of increase of temperature in said chamber, and said monitored temperatures and said monitored level of cryogenic liquid within said chamber are utilized to control the supply of cryogenic liquid to said chamber and thereby the volume of said liquid therein to carry out the deep cryogenic processing of said parts.

13. The method for carrying out the deep cryogenic processing of metallic, carbide, ceramic and plastic parts as claimed in claim 9 wherein the cryogenic liquid within said closed treatment chamber is introduced thereto through multiport manifold means to uniformly distribute and mix said liquid throughout the pool of cryogenic liquid within said chamber.

14. The method for carrying out the deep cryogenic processing of metallic, carbide, ceramic and plastic parts as claimed in claim 9 wherein the cold vapors within the upper part of said closed treatment chamber are force circulated within said chamber part to aid in the control of the evaporation of the cryogenic liquid in said chamber.

* * * * *